US008469456B2

(12) United States Patent
Buhr et al.

(10) Patent No.: US 8,469,456 B2
(45) Date of Patent: Jun. 25, 2013

(54) EJECTOR UNIT FOR A ROAD MILLING MACHINE OR THE LIKE

(75) Inventors: Karsten Buhr, Willroth (DE); Stefan Abresch, Dierdorf (DE); Thomas Lehnert, Oberraden (DE); Guenter Haehn, Koenigswinter (DE); Cyrus Barimani, Koenigswinter (DE)

(73) Assignee: Wirtgen GmbH (DE)

( * ) Notice: Subject to any disclaimer, the term of this patent is extended or adjusted under 35 U.S.C. 154(b) by 447 days.

(21) Appl. No.: 12/728,635

(22) Filed: Mar. 22, 2010

(65) Prior Publication Data

US 2010/0244544 A1 Sep. 30, 2010

(30) Foreign Application Priority Data

Mar. 25, 2009 (DE) ..... 10 2009 014 729
Mar. 25, 2009 (DE) ..... 10 2009 014 730

(51) Int. Cl.
*E21C 47/00* (2006.01)

(52) U.S. Cl.
USPC ..... 299/39.2; 299/39.8

(58) Field of Classification Search
USPC ..... 241/294; 299/39.8, 39.2, 89.2, 103, 299/87.1
See application file for complete search history.

(56) References Cited

U.S. PATENT DOCUMENTS

| | | | | | |
|---|---|---|---|---|---|
| 4,818,027 | A | | 4/1989 | Simon | |
| 5,101,583 | A | * | 4/1992 | Scordilis | 299/39.8 |
| 5,120,112 | A | * | 6/1992 | Kincaid | 299/67 |
| 5,333,938 | A | * | 8/1994 | Gale | 299/106 |
| 7,293,729 | B2 | * | 11/2007 | Ragnarsson | 241/291 |
| D624,940 | S | * | 10/2010 | Buhr et al. | D15/28 |
| D624,941 | S | * | 10/2010 | Buhr et al. | D15/28 |
| D624,942 | S | * | 10/2010 | Buhr et al. | D15/28 |
| D628,602 | S | * | 12/2010 | Buhr et al. | D15/28 |
| D632,703 | S | * | 2/2011 | Buhr et al. | D15/28 |

FOREIGN PATENT DOCUMENTS

| | | |
|---|---|---|
| DE | 3701905 C1 | 9/1988 |
| JP | 8003919 A | 1/1996 |

* cited by examiner

*Primary Examiner* — John Kreck
(74) *Attorney, Agent, or Firm* — Waddy & Patterson, P.C.; Lucian Wayne Beavers

(57) ABSTRACT

The invention relates to an ejector unit, in particular for a road milling machine, having an ejector that is replaceably mounted on a carrier. In one aspect the ejector is curved in a scoop-like fashion. In another aspect the ejector is reversible upon the carrier to allow the ejector to be reversed after one wear surface is worn, thus presenting a new second wear surface.

15 Claims, 6 Drawing Sheets

EJECTOR UNIT FOR A ROAD MILLING MACHINE OR THE LIKE

We, Karsten Buhr, a citizen of Germany, residing at Willroth, Germany, Stefan Abresch, a citizen of Germany, residing at Dierdorf, Germany, Thomas Lehnert, a citizen of Germany, residing at Oberraden, Germany, Guenter Haehn, a citizen of Germany, residing at Koenigswinter, Germany, and Cyrus Barimani, a citizen of Germany, residing at Koenigswinter, Germany have invented a new and useful "Ejector Unit For A Road Milling Machine Or The Like". This application claims priority from German Patent Applications No. 10 2009 014 730.6-25 and No. 10 2009 014 729.2-25, both filed Mar. 25, 2009.

BACKGROUND OF THE INVENTION

1. Field of the Invention

The invention relates to an ejector unit, in particular for a road milling machine, having an ejector that comprises a conveying surface.

2. Description of the Prior Art

Road milling machines usually comprise a milling tube on whose surface are mounted a plurality of bit holders. The bit holders are usually part of a bit holder changing system that also encompasses a base part. The base part is welded onto the surface of the milling tube, and replaceably receives the bit holders. The bit holder serves for mounting of a cutting bit, usually a round-shaft cutting bit, as known e.g. from published German patent application DE 37 01 905 C1. The bit holders are arranged on the surface of the milling tube so as to yield spiral-shaped helices. The helices proceed from the edge region of the milling tube and rotate toward the center of the milling tube.

The respective helices that proceed from the oppositely located edge regions therefore meet at the center of the milling tube. One or more ejectors are also then arranged in this region. The helices convey to the ejectors the material removed by the cutting bits. The ejectors then transport it out of the working region of the milling tube.

The ejectors are subject to severe abrasive attack, and must therefore be regularly checked and replaced. For this, the ejector welded onto the milling tube must be detached and a new one welded on. Attention must be paid to the exact positioning and alignment of the ejector in order to achieve ideal discharge performance. This replacement work in the confined working area of the milling tube is laborious.

SUMMARY OF THE INVENTION

It is an object of the invention to make available an improved ejector unit and ejector that enable simple machine maintenance.

1. The Ejector Unit

The ejector unit includes an ejector replaceably mountable on a carrying part. This results in a tool system in which the ejector can be easily and quickly replaced in the event of damage or wear. Work is thereby considerably simplified, and machine downtimes can be considerably reduced.

According to a preferred variant embodiment of the invention, provision can be made that the ejector is mountable on the carrier in at least two different operating positions.

The ejectors can be used in one operating position until the wear limit is reached. The ejector is then brought into the next operating position and can then be used further. This results in a service life for the ejector that is considerably extended as compared with usual ejectors.

Provision can be made in this context that in order to change the operating positions, the ejector is installed having been rotated 180 degrees. What is exploited here is the recognition that the ejector wears substantially on its region facing away from the milling tube. Once the wear state has been reached there, the ejector is detached and is reinstalled having been rotated 180 degrees. The ejector service life can thereby be considerably extended, ideally in fact doubled. In order to lose as little time as possible when changing the operating positions of the ejector, and to make installation unequivocal, provision can be made that the ejector and the holder form a mechanical interface that enables reversible installation of the ejector.

Secure mounting of the ejector on the carrier part results from the fact that the ejector comprises a mounting receptacle and/or a mounting extension, and that the ejector is connected indirectly or directly to the carrier by means of one or more mounting elements.

One conceivable inventive alternative is such that the ejector is braced in planar fashion on a support surface of the carrier by means of a mounting side, that the ejector comprises a securing extension and/or a securing receptacle, and that the securing extension engages into a securing receptacle of the carrier and/or a securing extension of the carrier engages into the securing receptacle of the ejector. The mutually interengaging connection of the securing extension and securing receptacle creates a positively engaged connection through which processing forces can be dissipated in load-optimized fashion. This becomes possible in particular when provision is made that the positively engaged connection impedes or blocks any offset of the ejector with respect to the carrier transversely to the feed direction.

In the context of the ejector unit according to the present invention, provision can be made that the carrier comprises a mounting foot onto which is shaped a support part, and that the mounting foot comprises a mounting surface extending substantially in the feed direction. By means of the mounting surface, the carrier can be positioned correctly on the milling tube and mounted thereon, in particular welded on.

The carrier can be produced in simple fashion as an economical component.

If provision is made that the mounting foot is widened with respect to the support part in or oppositely to the feed direction, a load-optimized geometry then results. The transition region between the support part and the mounting foot is exposed to large bending stresses in the tool insert. Widening decreases the material stresses at that point.

According to a preferred variant embodiment of the invention, provision can be made that the ejector comprises a conveying surface that is arranged substantially transversely to the feed direction of the ejector unit, and is embodied in hollowed fashion, in particular recessed in scoop-like fashion, at least locally in a direction opposite to the tool feed direction. This hollowed conformation enables a geometry that improves the discharge rate.

If provision is made that one or more depressions are introduced into the conveying surface, material removed during tool use can become deposited in the depressions. A "natural" wear protection layer forms there.

According a variant of the invention, provision can be made that at least one screw receptacle is used as a mounting receptacle, and that the screw receptacle opens, toward the front side of the ejector, into a screw head receptacle in which a screw head of a mounting screw is at least locally nonrotatably receivable. Rapid and problem-free ejector replacement is possible with the screw connections. Countersunk or partly countersunk reception of the screw head prevents abrasive attack on the countersunk head region. In addition, loosening of the screw at this point is prevented.

If the conformation of the ejector is such that one or more shaped-on stiffening ribs are arranged on the rear side facing away from the conveying surface, a sufficiently rigid ejector can then be designed with little material outlay.

A preferred variant of the invention is such that the mounting side comprises a convex mounting portion for contact against a concave receiving portion of a carrier. This results in a surface connection between the carrier and the ejector through which processing forces can be reliably dissipated even in the event of asymmetrical force application to the conveying surface.

If provision is made that the carrier holds the ejector in such a way that the conveying surface extends with a slight inclination with respect to the feed direction, the discharge performance can then be optimized. It has been shown that particularly good performance is achieved with an inclination setting in an angle range of +/−20 degrees. Surprisingly, an optimum is obtained at a negative inclination angle, specifically at an inclination of 5 to 15 degrees opposite to the feed direction.

An additional improvement in ejector service life is achieved by the fact that at least one wear protection element, made of a material more wear-resistant than the conveying surface, is arranged in the region of the conveying surface; provision can be made in particular that the wear protection element is constituted by a hard-material element or by a hardfacing.

2. The Ejector

The ejector comprises a mounting side, facing away from its conveying surface, having a support surface. With this mounting side, the ejector can be placed onto a component mounted on the milling tube, for example onto a carrying part welded thereon. By way of the support surface of the carrying part, the loads occurring during tool use are reliably dissipated at least in part. The ejector is equipped with a mounting receptacle or mounting extension, so that it is replaceably mountable. In this fashion it can easily be changed in the event of damage or wear.

According to a preferred variant embodiment of the invention, provision can be made that the conveying surface of the ejector is arranged transversely to the feed direction of the ejector unit, and is at least locally embodied in concave fashion or is assembled, in the hollowed region, from line segments and/or curve segments. The concave or hollowed conformation enables a scoop-like geometry that improves the discharge rate.

To allow the ejector to be reliably braced on a carrying part, provision can be made that at least one protruding securing extension, or a recessed securing receptacle, is arranged on the side facing away from the conveying surface. Transverse forces that occur can then be transferred, in particular, in positively engaged fashion from the ejector into the carrying part. This is possible in particular when provision is made that by means of the at least one securing extension or the at least one securing receptacle, any displacement of the ejector in a plane transverse to the feed direction can be limited in positively engaged fashion.

Provision can be made according to the present invention that the screw receptacle is guided through the securing extension or securing receptacle. The carrying part is then utilized for a sufficient clamping length of the mounting screw.

A preferred configuration of the invention is such that the mounting side is embodied in such a way that the ejector is installable in different operating positions. The ejector can, in particular, be embodied in mirror-symmetrical fashion, or can be embodied in the region of a mounting side in such a way that it enables installation reversibly in two different operating positions. Also conceivable is an ejector that enables three or four different operating positions.

This is based on the recognition that the ejector becomes worn substantially on its region facing away from the milling tube. Once the worn state is achieved there, the ejector is removed and put back on having been rotated, for example, 180 degrees.

A preferred configuration of the invention is such that the mounting side comprises a convex or crowned or spherical mounting portion for contact against a concave or hollowed receiving portion of a carrier. This connection creates a large connecting surface that ensures good energy transfer even when the conveying surface is asymmetrically loaded. A further improvement in service life is achieved by the fact that at least one wear protection element, made of a material more wear-resistant than the conveying surface, is arranged in the region of the conveying surface. In this context, provision can be made in particular that the wear protection element is constituted by a hard-material element, for example carbide or ceramic, or by an applied coating, for example a hardfacing.

BRIEF DESCRIPTION OF THE DRAWINGS

The invention will be further explained below with reference to an exemplifying embodiment depicted in the drawings, in which.

DETAILED DESCRIPTION OF THE INVENTION

Figure 1:
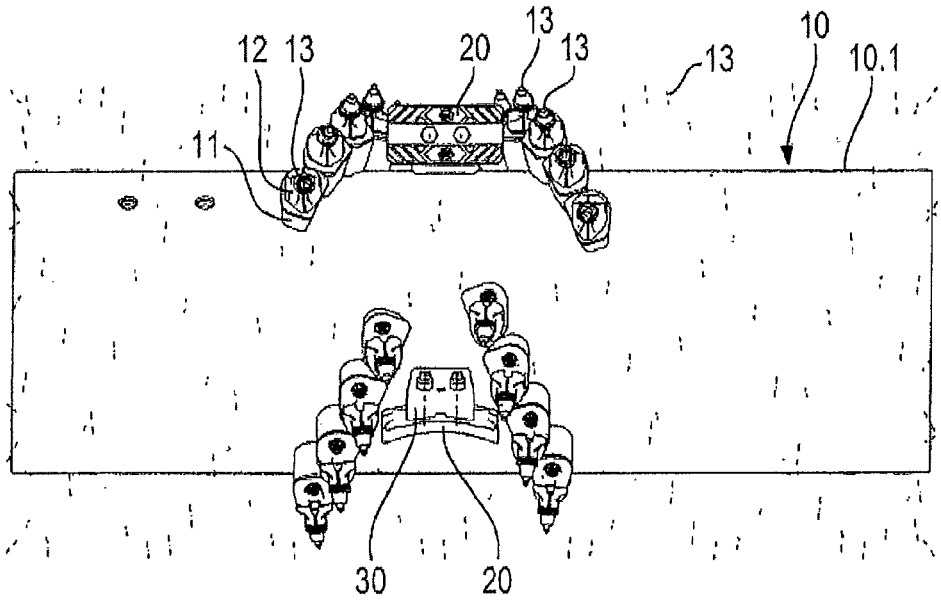
FIG. 1 is a front view of a milling drum of a road milling machine.
Figure 2:
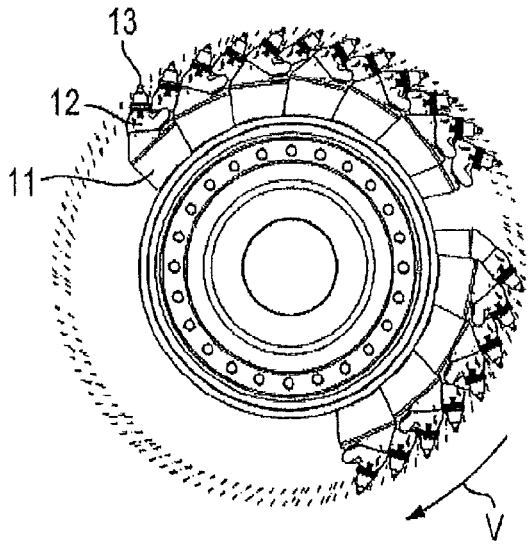
FIG. 2 is a side view of the milling drum according to FIG. 1.

FIG. 1 shows a milling drum having a cylindrical milling tube 10 onto whose drum surface 10.1 are welded a plurality of base parts 11 of bit holder changing systems. Base parts 11 carry replaceable bit holders 12. A cutting bit 13, specifically a round-shaft cutting bit, is replaceably received in each bit holder 12. Base parts 11 are arranged with respect to one another so that they form a helix, specifically a transport helix. The helix rotates, proceeding from the side of milling tube 10 on drum surface 10.1, toward the milling tube center formed between the two sides. For better clarity, only some of the bit holder changing systems are depicted in FIGS. 1 and 2. Dashed lines that represent the center longitudinal axis of cutting bits 13 are shown as substitutes for the bit holder changing systems (not shown). As is evident from these lines, multiple transport helices are located on either side of the milling tube center.

Figure 3:
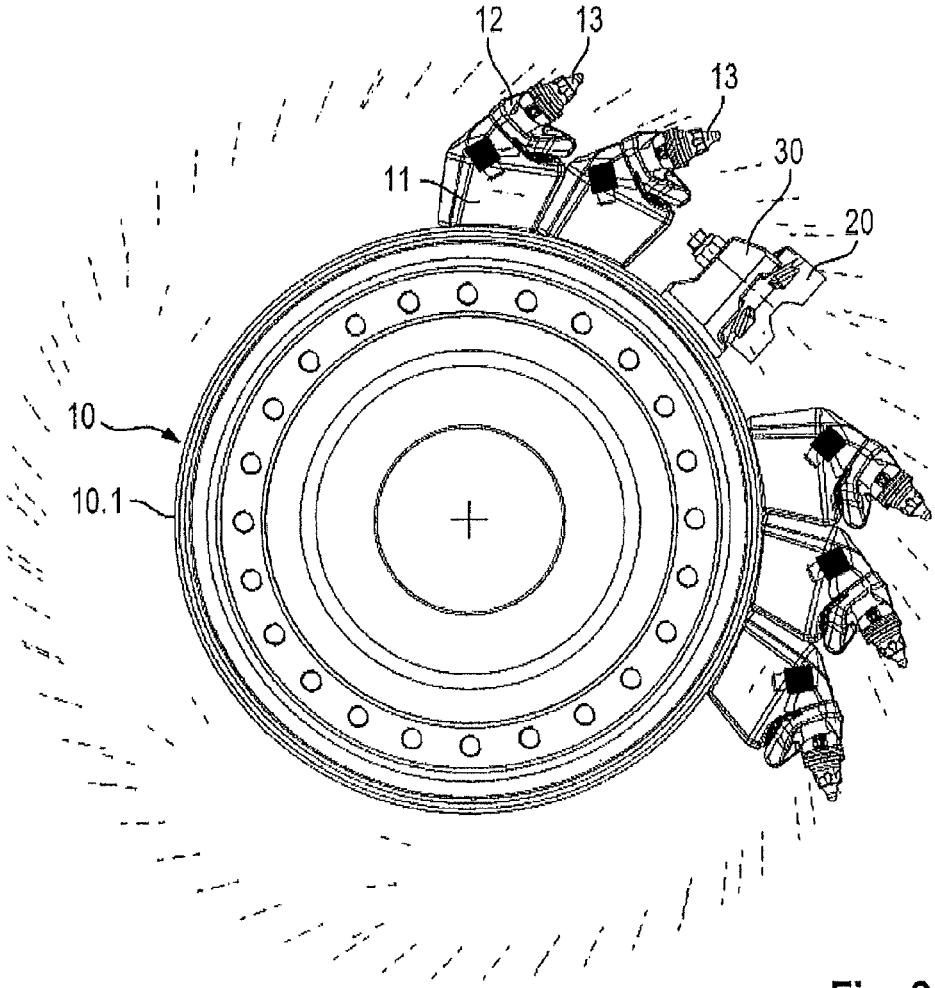
FIG. 3 shows the view according to FIG. 2, enlarged and with a slightly modified depiction.

The transport helices meet in pairs in the region of the milling tube center. As is evident from FIG. 1, at least one respective ejector unit is arranged there. FIG. 3, as compared with the depiction in FIG. 2, does not show the bit holder changing systems, redirecting attention to the ejector unit. As is evident from this depiction, the ejector unit is constituted by a carrying part 30 and an ejector 20.

Figure 4:
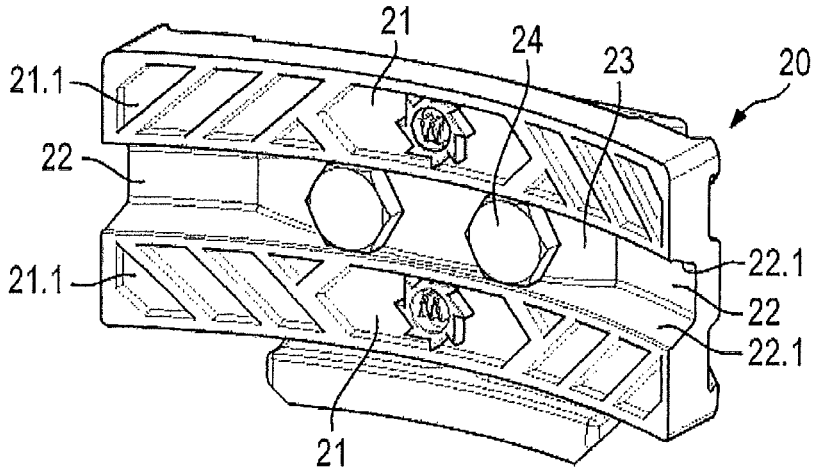
FIG. 4 is a perspective front view of an ejector unit.
Figure 5:
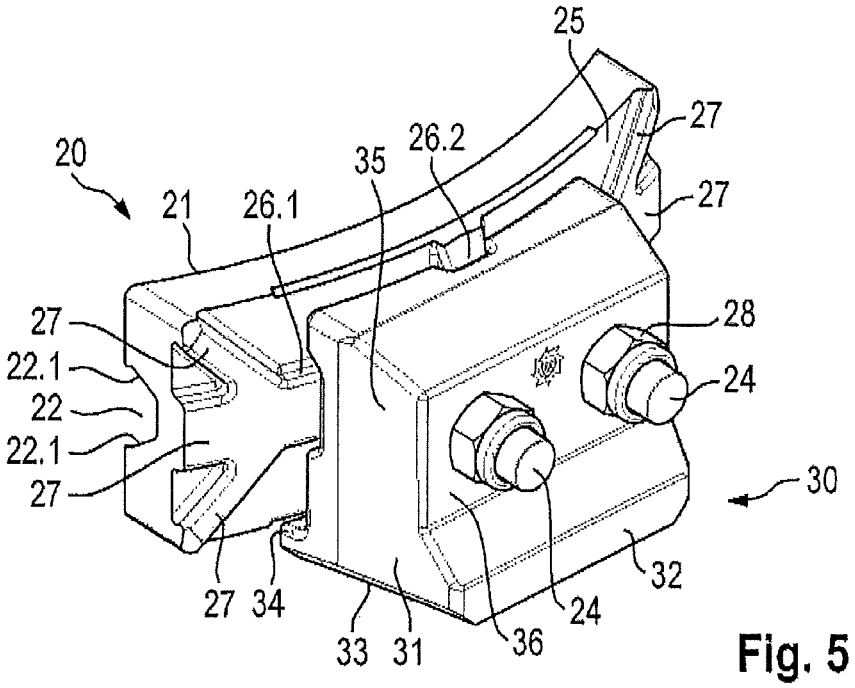
FIG. 5 is a perspective rear view of the ejector unit according to FIG. 4.

FIGS. 4 and 5 show the ejector unit in isolation.

Figure 6:
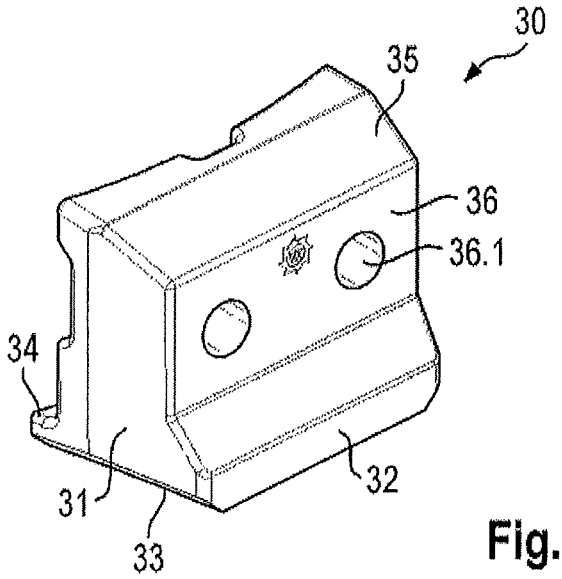
FIG. 6 is a perspective rear view of a carrier of the ejector unit according to FIG. 5.
Figure 7:
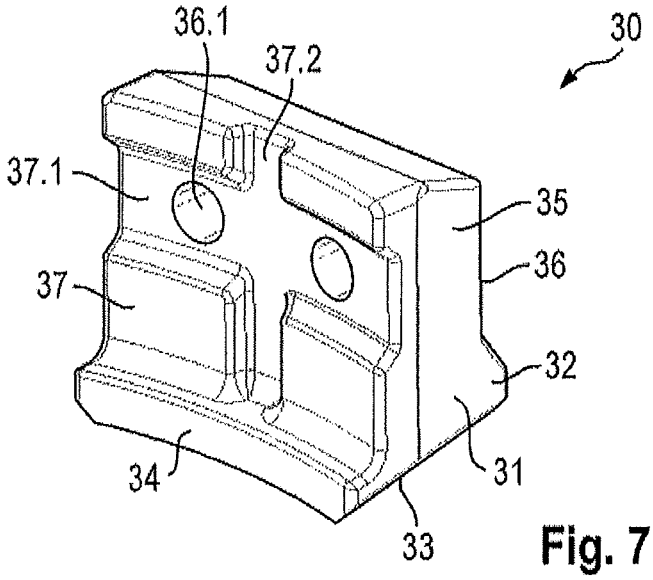
FIG. 7 is a front perspective view of the carrier according to FIG. 6.

Firstly the design of carrying part 30 will be explained with reference to FIGS. 6 and 7. Said part comprises a mounting foot 31 that forms on its underside a mounting surface 33. With this, carrying part 30 can be placed onto drum surface 10.1 and welded at the sides. Shaped onto mounting foot 31 is an upwardly projecting support part 35 that forms a rear side 36. Mounting foot 31 is widened by means of an extension 32 over rear side 36, so that it forms a wide mounting surface 33 having a large support spacing. The widened cross section produced by extension 32 furthermore brings about a reinforcement of the highly stressed transition region between mounting foot 31 and carrying part 35. A further widening of mounting surface 33 is achieved with a front-side protrusion 34 that, like extension 32, extends over the entire width of carrying part 30. Carrying part 30 comprises on the front side a support surface 37 that extends over the front side of carrying part 35 and also over part of mounting foot 31. This embodiment of support surface 37 enables strength-optimized bracing of ejector 20. Two receptacles 37.1, 37.2 are inset into support surface 37. The two receptacles 37.1, 37.2 are recessed into support surface 37 so that they form trough-like hollows.

Ejector 20 will be explained below with reference to FIGS. 8 and 9. It is embodied in plate-shaped fashion as a drop forged part, and is therefore particularly rigid. Ejector 20 comprises a front-side conveying surface 21.

Said surface is equipped with recesses 21.1, 22. Located between recesses 21.1 are ribs that are at an angle to the vertical and are thus inclined toward the center of the ejector. The recesses receive removed material during operational use, thus forming a "natural" wear protector. A particularly good conveying rate is furthermore achieved by the fact that conveying surface 21 is embodied in concave, and thus scoop-shaped, fashion. Recess 22 comprises two oblique surfaces 22.1 that are at an angle to conveying surface 21 and assist the conveying action.

Located between the two recesses 22 is a thickened extension 23 that receives two screw receptacles 29 embodied as through holes. Screw receptacles 29 transition on the front side into hexagonal screw head receptacles 29.1.

Figure 9:
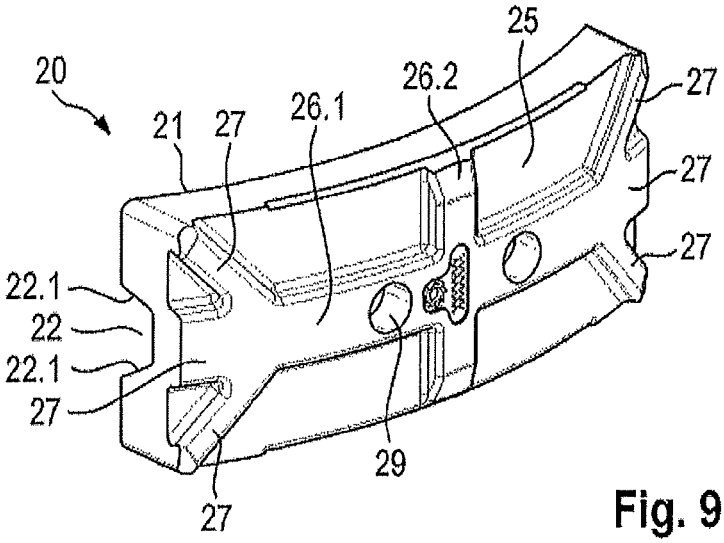
FIG. 9 is a perspective rear view of the ejector according to FIG. 8.

FIG. 9 shows the rear side of ejector 20. As is evident from this depiction, rib-like securing extensions 26.1, 26.2 project from ejector 20 on the rear side. Securing extensions 26.1 and 26.2 are adapted, in terms of their arrangement and dimensioning, to the arrangement and shape of receptacles 37.1 and 37.2 of carrier 30. Screw receptacles 29 are guided through securing extension 26.1.

As is further evident from FIG. 9, stiffening ribs 27 are arranged in the rear-side corner regions of ejector 20. Said ribs are connected to the horizontal securing extension 26, thus yielding optimum energy dissipation.

In order to mount ejector 20, it is placed with its rear side onto support surface 37 of carrier 30. Securing extensions 26.1, 26.2 then engage into the corresponding receptacles 37.1, 37.2. This results in a crosswise splining that prevents any displacement of ejector 20 with respect to carrier 30 in the axial and radial direction of milling tube 10. By way of this splined connection, large portions of the forces occurring during tool use can be dissipated.

Screw receptacles 29, 36.1 of ejector 20 and of carrier 30 are in alignment, so that mounting screws 24 (see FIGS. 4 and 5) can be inserted through them. The screw head of mounting screws 24 is accommodated in screw head receptacle 29.1, where it is held nonrotatably. Preferably self-locking nuts 28 can be screwed onto mounting screws 24, and ejector 20 can thus be secured on carrier 30.

It is chiefly the radially projecting region of ejector 20 that wears during tool use. As is evident from FIGS. 8 and 9, ejector 20 is embodied symmetrically with respect to the center transverse plane. When the wear limit is reached, it can therefore be removed and put back on having been rotated 180 degrees.

Figure 10:
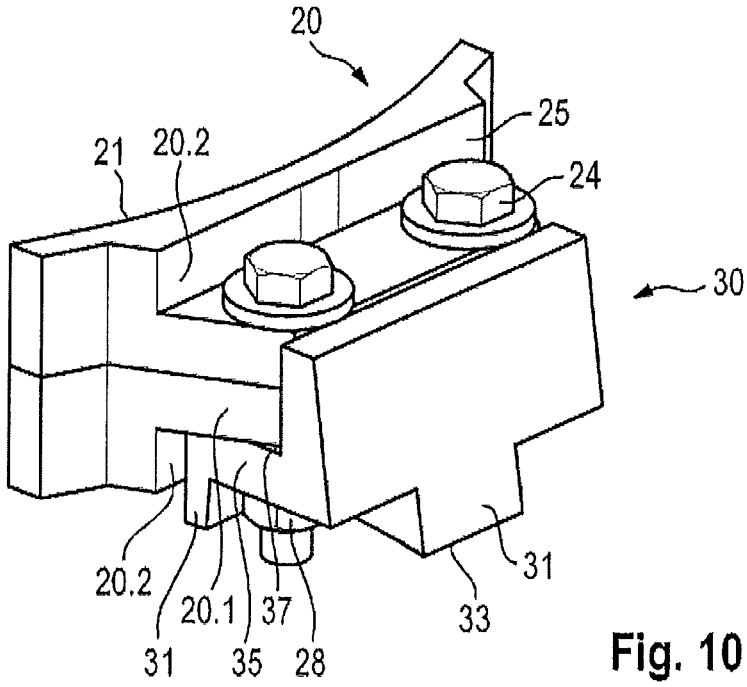
FIG. 10 is a perspective rear view of a second embodiment of an ejector unit having an ejector and a carrier.
Figure 11:
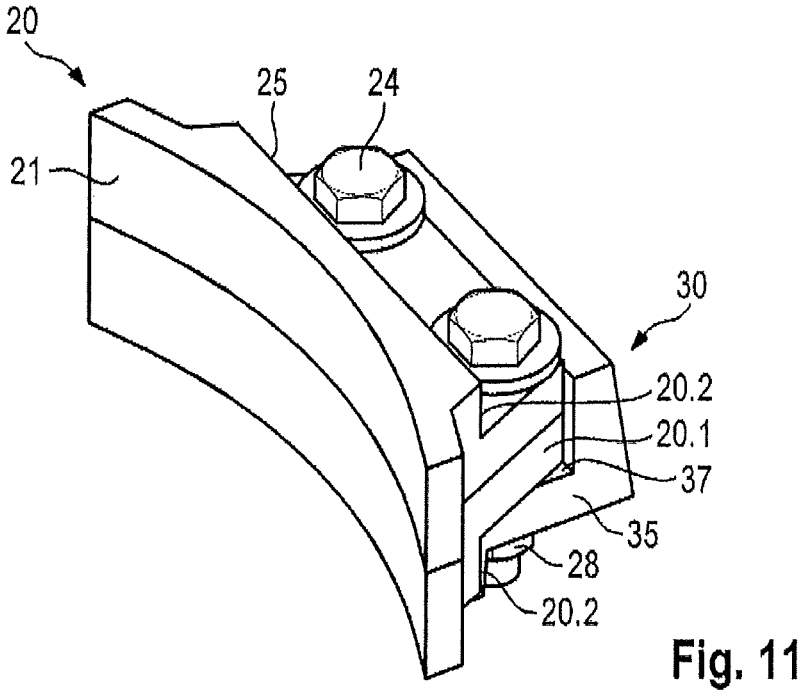
FIG. 11 is a perspective front view of the arrangement according to FIG. 10.

FIGS. 10 and 11 show a further variant embodiment of an ejector unit according to the present invention. Said unit once again encompasses an ejector 20 and a carrier 30. Ejector 20 again possesses a hollowed conveying surface 21 that faces in the processing direction, the hollow being recessed concavely in a direction opposite to the processing direction. Facing away from conveying surface 21, ejector 20 comprises on its rear-side mounting side 25 a mounting extension 20.1. The latter protrudes in block fashion oppositely to the processing direction. It possesses two screw receptacles that can be arranged in alignment with screw receptacles of carrier 30.

Mounting screws 24 can be passed through the screw receptacles, and nuts 28 can be threaded onto their threaded studs. Ejector 20 is thereby fixedly braced against a support surface 37 of carrier 30. As is evident from the drawings, ejector 20 is equipped in the region of mounting side 25 with cutouts 20.2. Upper cutout 20.2 receives the heads of mounting screws 24 and thus protects them, behind conveying surface 21, from the abrasive attack of the removed material. Lower cutout 20.2 extends in skirt fashion over carrier 30 and protects it there. Ejector 20 is symmetrical with respect to the central transverse axis, and can therefore be mounted reversibly in two operating positions, rotated 180 degrees, on carrier 30.

FIG. 3 is an end view of the milling tube 10 which can also be referred to as a milling drum 10. The milling drum 10 rotates in the feed direction indicated by the arrow V. The milling drum rotates about an axis indicated by the + in the center of the milling drum in FIG. 3. Directions generally parallel to the rotational axis may be referred to as axial directions and directions extending generally radially outward from the axis may be referred to as radial directions. Both the axial and radial directions can be considered to be generally transverse to the feed direction V.

Figure 8:
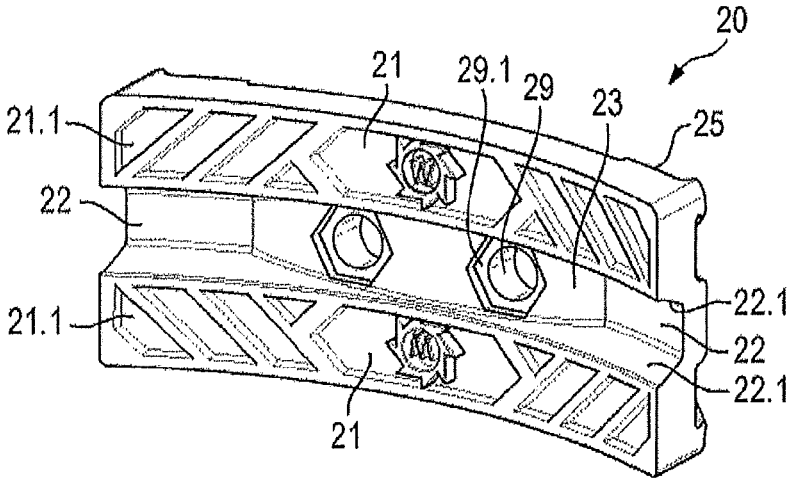
FIG. 8 is a perspective front view of an ejector of the ejector unit according to FIG. 4.

The ejector 20 seen in perspective in FIGS. 8 and 9, and in end view in FIG. 3, can be described as being generally rectangular in shape having a width which extends in a generally radial direction and a length extending in a generally axial direction. The conveying surface 21 of the ejector 20 may be described as generally forward facing or as facing in the working direction V.

As best seen in FIG. 3, the carrier 30 may support the ejector 20 at an angle $\alpha$ to a radius of the milling drum, which angle may be in a range of +/−20 degrees, and more preferably a negative angle from about −5 degrees to about −20 degrees.

What is claimed is:

1. An ejector for a road milling machine, comprising:

a generally rectangular ejector body having a length and a width, the body having a front conveying side and a rear mounting side, the body being curved along at least part of its length so that the front conveying side is concave lengthwise and the rear mounting side is convex lengthwise; and a lengthwise extending mounting rib protruding from the rear mounting side, the ejector body being symmetrical about the mounting rib in a widthwise direction so that the ejector body can be reversibly mounted in either of two mounting positions rotated 180° from each other.

2. The ejector of claim 1, further comprising:

first and second lengthwise spaced mounting holes defined through the ejector body between the front conveying side and the rear mounting side and extending through the mounting rib.

3. The ejector of claim 1, further comprising:

a widthwise mounting rib protruding from the rear mounting side, the ejector body being symmetrical about the widthwise mounting rib in a lengthwise direction.

4. The ejector of claim 3, wherein:

the lengthwise and widthwise mounting ribs are integrally formed in the ejector body and cross at a center of the rear mounting side.

5. The ejector of claim 1, wherein:

the front conveying side has defined therein a lengthwise extending recess opposite from the lengthwise extending rib, thereby defining first and second lengthwise extending forward facing conveying surfaces adjacent lengthwise edges of the front conveying side.

6. The ejector of claim 5, wherein:

each of the forward facing conveying surfaces has a plurality of depressions defined therein, so that debris can pack into the depressions during use to create an abrasion resistant debris layer on the front conveying side.

7. The ejector of claim 5, further comprising:

first and second screw holes extending through the ejector body and having polygonal shape screw head receptacles defined in the recess of the front conveying side.

8. The ejector of claim 1, further comprising:

four diagonal stiffening ribs protruding from the rear mounting side and extending from each of four corners of the rear mounting side to the lengthwise extending mounting rib.

9. An ejector unit for a road milling machine, the milling machine including a milling drum rotatable in a feed direction about a rotational axis, the rotational axis defining an axial direction parallel to the axis and a radial direction extending radially from the axis, the ejector unit comprising:

a carrier including a mounting foot shaped to be received on the milling drum, and a support portion extending from the mounting foot, the support portion including a forward facing support surface and first and second crossing support recesses defined in the support surface; and an ejector including a forward facing conveying surface and including first and second rearward extending crossing extensions complementary to and received in the first and second crossing support recesses of the carrier, so that engagement of the crossing extensions with the crossing recesses supports the ejector against both axial and radial motion relative to the carrier, the ejector being curved in a generally axial direction so that the conveying surface is concave.

10. The ejector unit of claim 9, wherein:

the first support recess extends generally in an axial direction and the second support recess extends generally in a radial direction; and the carrier and ejector include at least two aligned bolt holes extending through the first support recess and the first extension, the two aligned bolt holes being on opposite sides of the second support recess and the second extension.

11. The ejector unit of claim 9, wherein:

the first extension of the ejector extends across the ejector in a generally axial direction; and the conveying surface of the ejector includes a recess located oppositely from the first extension and extending across the ejector in a generally axial direction.

12. The ejector unit of claim 9, wherein:

the ejector is symmetrical about the crossing extensions in both an axial and a radial direction, so that a mounting position of the ejector on the carrier is reversible between at least two positions.

13. The ejector unit of claim 9, wherein:

the support portion of the carrier extends relative to the mounting foot such that the carrier supports the ejector at a negative angle in the range of from about −5 degrees to about −20 degrees relative to a radius of the milling drum.

14. The ejector unit of claim 9, wherein:

the mounting foot of the carrier is wider than the support portion of the carrier parallel to the feed direction.

15. The ejector unit of claim 9, wherein:

the ejector comprises a plurality of depressions defined in the conveying surface, so that debris can pack into the depressions during use.

* * * * *